US007075039B2

(12) United States Patent
de los Toyos et al.

(10) Patent No.: US 7,075,039 B2
(45) Date of Patent: Jul. 11, 2006

(54) RADIANT HEATER FOR A COOKER, WITH A MOULDED INSULATING BASE

(75) Inventors: Daniel de los Toyos, Eibar (ES); Jon Endika Azpiritxaga, Durango (ES)

(73) Assignee: S. Coop Elka, Etxebarria (ES)

( * ) Notice: Subject to any disclaimer, the term of this patent is extended or adjusted under 35 U.S.C. 154(b) by 0 days.

(21) Appl. No.: 11/106,880

(22) Filed: Apr. 14, 2005

(65) Prior Publication Data

US 2006/0027562 A1 Feb. 9, 2006

(30) Foreign Application Priority Data

Aug. 5, 2004 (ES) ..... 200401910 U

(51) Int. Cl.
*H05B 3/68* (2006.01)

(52) U.S. Cl. ..... 219/460.1; 219/461.1

(58) Field of Classification Search ..... 219/443.1, 219/445.1, 446.1, 448.11, 460.1, 461.1, 462.1, 219/463.1, 464.1, 544, 546, 547, 548
See application file for complete search history.

(56) References Cited

U.S. PATENT DOCUMENTS 4,357,436 A * 11/1982 Zucker et al. ..... 524/448
4,414,465 A * 11/1983 Newton et al. ..... 219/448.14
4,864,105 A * 9/1989 Morgan et al. ..... 219/542
4,983,810 A * 1/1991 Balderson ..... 219/445.1
5,532,458 A * 7/1996 Kratel et al. ..... 219/460.1

* cited by examiner

*Primary Examiner*—Sang Paik
(74) *Attorney, Agent, or Firm*—The Kline Law Firm

(57) ABSTRACT

The radiant heater (1) adapted to a warmer type electric cooking plate (2) comprises an insulating base (4) supporting a heating resistor (5) resting on a central area (4*a*) fixed by means of metal staples (11) inserted in it, while the insulating base is provided with a guide slot (10) for the heating resistor, a peripheral annular area (4*b*) for fastening in a metal tray (3), and a vertical annular wall (4*c*) forming an enclosure below the heated plate area (2), wherein the insulating base is made of a single piece, moulded with a vermiculite mix insulating material and at least one binder compound in an aqueous solution, and a water-repellent additive in a proportion of less than 5%, the density of the resultant insulating moulding after drying being more than 350 Kg/m3.

4 Claims, 1 Drawing Sheet

RADIANT HEATER FOR A COOKER, WITH A MOULDED INSULATING BASE

BACKGROUND OF THE INVENTION

The present invention is related to a radiant heater for an electric cooking plate and to its insulating base for carrying the heating resistor, made by moulding of a vermiculite-based insulating material with a dimensional stability and mechanical strength.

PRIOR ART

Known radiant heaters are provided with a heating resistor arranged on a circular insulating base, and they are set in place under a heating plate made of glass ceramic or similar material, the latter reaching a temperature of less than 350° C. The low temperature heaters are used for warming ready cooked foods. The heating resistors barely reach 500° C., a value considerably lower than the 1000° C. of high power radiant heaters. Due to the low working temperature, on warmer type heaters there is no need for an insulating base made of a material with high thermal properties, nor with such good thermal insulation as that of the microporous silica aerogel material used in high temperature heaters. To manufacture low temperature warmer type heaters, a moulded insulating base is preferable with a vermiculite or expanded mica based insulating material, because the latter, although it is not an excellent heat insulator does have good mechanical properties, is resistant to impacts and scuffing, and permits a moulded insulating base configuration with sound dimensional stability. Furthermore, such machining operations as drilling and material removal operations may be performed on a insulating base made of vermiculite.

An example of radiant heater wherein the heating resistors are made of coiled wire is disclosed in GB-1580909-A. The resistors are supported on a central area of the insulating base by means of fastening staples inserted into the insulating material. The insulating material from which the support base is made is microporous and moulded by means of a mixture of silica aerogel and reinforcement fibres, with excellent heat insulation but poor mechanical properties. This insulating base provides a rather weak retaining force on the zone of the staples.

In the radiant heater disclosed in U.S. Pat. No. 4,713,527, the insulating base is moulded with a vermiculite insulating material, but the wire coil heating resistors are embedded down to a depth in the insulating base at the same time as the moulding operation. This method of fixing the heating resistors by means of embedding during the insulating base moulding process, requires the grains of vermiculite to be mixed with a binder component, which already contains in itself the water-repellent property against absorption of environmental moisture inside the insulating base. On this known radiant heater, owing to its fastening by means of embedding, retaining of the heating resistors on the surface of the insulating base is strengthened by means of a silicone surface treatment around the inserted part of the resistor wires.

In a specimen radiant heater disclosed in U.S. Pat. No. 4,471,214, the insulating base is formed with two layers of different material. The coiled wire heating resistors are inserted by means of a press stroke, on a supporting base with good mechanical properties but poor heat insulation. Due to this, the radiant heater uses a bottom insulating layer made from a good heat insulating material. The surface of the support layer carrying the heating resistors is impregnated with a reinforcing material, such as a silica sol, with the drawback of having its heat insulation property impaired thereby. For this reason the heating resistor support layer is made of water-absorbing insulating material, while the insulating layer below unaffected by the heating resistor fastening means, is made of a comparatively water-repellent material, after receiving a silicone group additive.

DISCLOSURE OF THE INVENTION

The object of the present invention is a radiant electric heater adapted to a low working temperature cooking plate for warming processes, provided with an insulating base carrying coiled wire heating resistors made in the form a wire coil, and supported in guide slots in the surface of the insulating base, wherein the insulating base is made by moulding a single piece of homogeneous insulating material, such as vermiculite or expanded mica or the like, with good mechanical properties and dimensional stability and resistant to moisture absorption.

The insulating base is moulded with a surface layout comprising at least one recess in the form of a spiral slot, distributed over the whole circular area of the insulating base for the purpose of guiding the heating resistor, and a peripheral annular rim of said area for supporting the resistors, which has to be resistant to impact and scuffing, since the annular rim is hammered with an element fastening the insulating to the metal tray. The insulating base, made of a single layer of vermiculite material or the like and compacted, may also include a housing cavity or recess whose geometric outline and depth are adapted for fastening an electrical component, situated on a surface area adjacent to the heating resistors.

A further object of the invention is to provide a low working temperature warmer type radiant heat with an insulating base moulded with a high density insulating material with good mechanical properties for the insertion in the material of the heating resistor retaining staples, while at the same time maintaining its water absorption capacity below 5% by weight by means of mixing the vermiculite grain with a binder component in an aqueous solution and a water-repellent additive.

The insulating base supporting the resistors, while at the same time resisting the tensile stress on the resistors and retaining staples, maintains a low thermal conductivity by means of limiting the density of the material compacted by moulding below a maximum value.

DETAILED DESCRIPTION OF AN EMBODIMENT OF THE INVENTION

Figure 1:
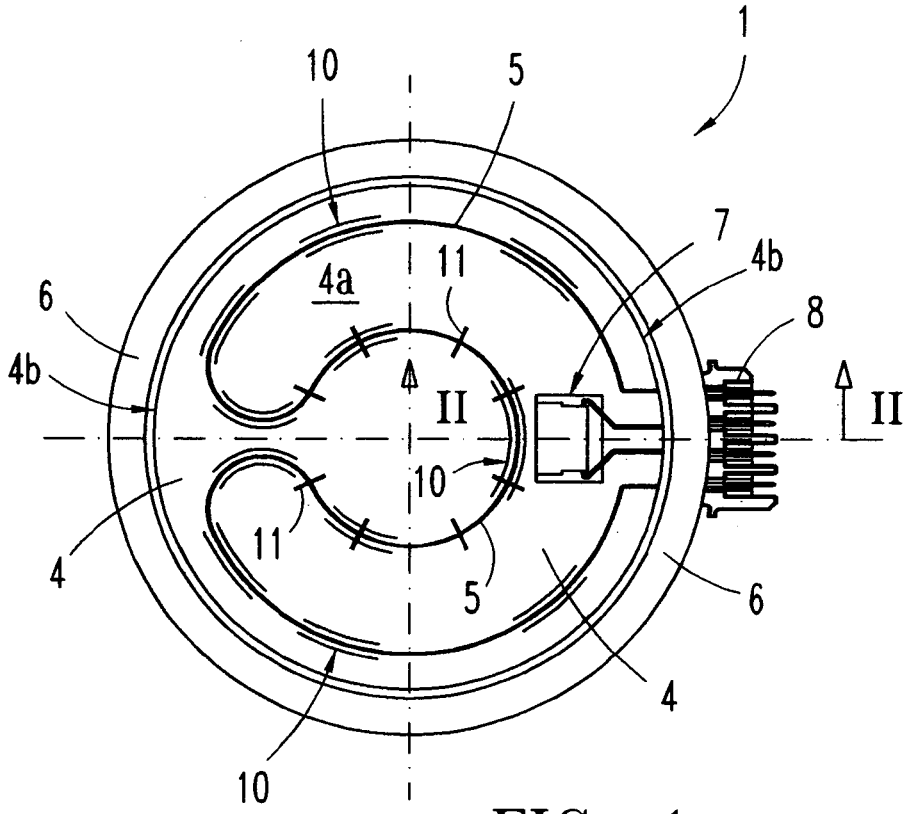
FIG. 1 is a plan view of an electric heater adapted to a cooking plate, provided with an insulating base with a surface for fixing the heating resistors.
Figure 2:
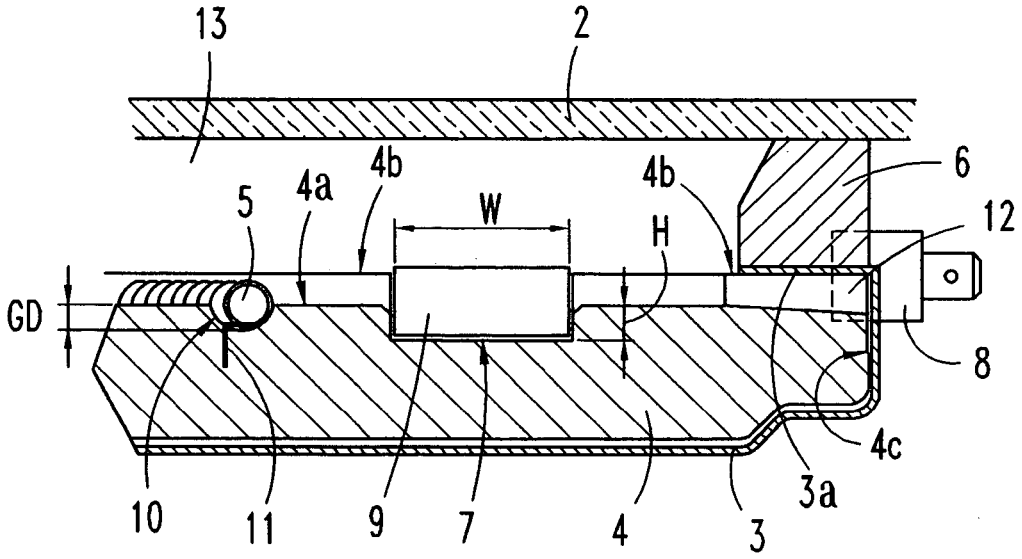
FIG. 2 is a partial cross-sectional view of the radiant heater according to line II—II in FIG. 1, shown under a glass ceramic plate.

In reference to FIGS. 1–2, a preferred embodiment of radiant heater 1 is adapted to a glass ceramic cooking plate 2 and is provided with an insulating base 4 made by a single layer of uniform material, on the surface of which are fixed one or more heating resistors 5 and a metal tray 3 covering the insulating base 4 underneath. It is also optionally provided with a peripheral insulating ring 6 in contact with the cooking plate 2, resting on the annular rim 4*b* of the insulating base. The insulating base 4 and the peripheral insulating ring 6 may form a single U-section piece moulded from a single material.

The power of the heater described here as a specimen embodiment is 250 W, below 1 W/cm2 of heated plate area, this is substantially less than the power of the heaters for cooking by means of strong heating, which are 750–1250 W. The heating resistors 5 are mounted on a central area 4*a* on the insulating base 4, guided in a corresponding slot 10, and they are made of coiled wire spread over the circular area 4*a*. The cross section of the slot 10 is of shallower depth "GP" than the diameter of the resistor 5, so that the wire coil 5 is only partly housed in the slot 10.

In an embodiment according to the invention, the insulating base 4 is formed by means of molding a single insulating layer of a homogeneous insulating material, which is made of vermiculite (a fiber free material) in a preferred amount of 60–80% by weight, and a preferred grain size of less than 2 mm, a binder component in aqueous solution in a proportion of more than 20% by weight, the binder being an inorganic material such as sodium or potassium silicate, and a water-repellent additive, such as a silicone group to help limit moisture absorption to less than 5% after drying. The molding of the insulating base may be carried out also in the metal tray 3. Thus, by means of molding and subsequent drying a density of the molded piece 4, such as 400–500 Kg/m$^3$, is achieved. The resultant density of the pressing of the vermiculite mix in a separate mold, or in the metal tray itself, has a subsequent effect on the retaining force that the insulating base 4 will exert of the staples 11 fastening the resistors 5. A retaining force of 500g is attained when the density of the insulating material compacted is greater than 350 Kg/m3. This minimum density value is also necessary to ensure that the molded piece used as the heater 1 insulating base 4 acts as an agent limiting moisture absorption below 5% by weight, preferably between 0.5% and 5%, in order to achieve the property of electrical insulation as well.

Furthermore, the increase in density gives rise to the enhanced thermal conductivity of the insulating base, whereby, in order to ensure that this thermal characteristic is less than 0.4 W/m.K, the density of the compacted material has to be limited to a maximum value of 700 Kg/m3 so as not to sacrifice the thermal insulation property of the insulating base 4. The optimum results of a high mechanical retaining force, a low water absorption and a high electrical insulation property are obtained by means of a compacted moulded piece, with a vermiculite mix and with the aforesaid water-repellent additive made of a silicone compound, the mix being pressed and dried up to a high density, the best range of values of which for achieving the object of the invention is 400–500 Kg/m3.

A cylindrical wall 4*c* is shaped at the peripheral edge of the of the insulating base 4, forming an air cavity 13 between this central surface 4*a* and the cooking plate 2, which normally has a height of 20–25 mm. The insulating base 4 is shaped with a peripheral annular ring 4*b* by means of which the insulating base 4 is attached to the metal tray 3. In the attaching operation a right-angle bent cut-out 3*a* of the metal tray is hammered against the surface of the annular rim 4*b*, without the insulating base 4 being damaged thereby. The annular rim 4*b* may or may not be raised in relation to the support surface 4*a* of the base for carrying a spacer insulating ring 6.

The insulating base 4 is provided with a recess 7 for housing a thermal switch 9, disposed on the central support surface 4*a*, situated next to a guide slot 10 and a heating resistor 5, and the body of the thermal switch 9 is supported on the recess 7. Being a guide slot 10 of a depth "GD", the housing recess 7 is of a depth H, the same or greater than the depth "GD" of the slot 10. The housing recess 7, moulded in the central area 4*a* of the insulating base, has a width "W" of several centimeters and a moulding depth H of several millimeters, sufficient to hold the thermal switch 9 still by pressure contact on the surface 4*a* of the insulating base, thereby preventing its subsequent movement.

The insulating base 4 is conformed with said vertical wall peripheral rim 4*c*, on which rests an insulating ring 6 for spacing the heating resistor 5 from the cooking plate 2. A transverse housing 12 for an electrical connector 8 of the radiant heater 1 is formed, in the above-mentioned vertical wall rim by means of hollowing out material.

What is being claimed is:

1. An electrical radiant heater adapted to a low temperature warmer type cooking plate (2) comprising:

at least one heating resistor (5) extended below a heated plate (2) area, an insulating base (4) secured in a metal tray (3) and disposed parallel to the cooking plate (2), with a substantially flat central area (4*a*) on which the heating resistor (5) is supported and fastened by means of metal staples (11) inserted in it, said insulating base (4) being made of a homogeneous molded material and comprising at least a guide slot (10) to receive the heating resistor (5) in the central support area (4*a*), a peripheral annular area (4*b*) for attaching the insulating base (4) to the metal tray (3), and a vertical annular wall (4*c*) forming an air enclosure (13) below the heated plate (2) area, wherein the insulating base (4) is molded from an insulating material made of a mixture of at least 60% fiber free insulating material such as vermiculite and at least an inorganic binder compound in an aqueous solution and a water-repellent additive, the density of the resultant insulating molding after being dried being more than 350 Kg/m$^3$ with a moisture content of less than 5% by weight.

2. The electrical radiant heater according to claim 1, wherein the molded insulating base (4) is a single compact piece with a density after drying of 400–500 Kg/m$^3$.

3. The electrical radiant heater according to claim 1, wherein the proportion of the water-repellent additive in the mixture is between 0.5% and 5%, so as to render the insulating base (4) highly electrically insulative.

4. The electrical radiant heater according to claim 1, wherein the insulating base (4) is also provided with a surface support recess (7) for a thermal switch (9), the recess (7) being situated next to a guide slot (10) for the heating resistor, said recess (7) being of sufficient depth (H) to keep the thermal switch (9) in a fixed position in relation to said guide slot (10).

* * * * *

UNITED STATES PATENT AND TRADEMARK OFFICE

CERTIFICATE OF CORRECTION

PATENT NO. : 7,075,039 B2
APPLICATION NO. : 11/106880
DATED : July 11, 2006
INVENTOR(S) : de Los Toyos et al.

It is certified that error appears in the above-identified patent and that said Letters Patent is hereby corrected as shown below:

On the cover page, item (73), the Assignee, incorrectly reads [[S. Coop Eika]]. The Assignee should be listed as Eika, S. Coop.

Signed and Sealed this

Twelfth Day of September, 2006

JON W. DUDAS
*Director of the United States Patent and Trademark Office*